United States Patent [19]

Catterson et al.

[11] 3,958,906

[45] May 25, 1976

[54] ROTARY ENGINE WITH MODIFIED TROCHOIDALLY SHAPED INNER WALL

[75] Inventors: Robert K. Catterson; Robert K. Mitchell, both of Brookfield, Wis.

[73] Assignee: Briggs & Stratton Corporation, Wauwatosa, Wis.

[22] Filed: Dec. 23, 1974

[21] Appl. No.: 535,966

[52] U.S. Cl. ..... 418/61 A; 418/124; 123/8.45

[51] Int. Cl.[2] ..... F01C 1/02; F01C 19/04; F02B 55/14

[58] Field of Search ..... 418/61 A, 123, 124, 418/113; 123/8.01, 8.45

[56] References Cited

UNITED STATES PATENTS

| | | | |
|---|---|---|---|
| 3,102,492 | 9/1963 | Bentele et al. | 418/61 A |
| 3,139,072 | 6/1964 | Froede | 418/113 |
| 3,465,729 | 9/1969 | Jones | 418/61 A |
| 3,853,438 | 12/1974 | Sato | 418/123 |

FOREIGN PATENTS OR APPLICATIONS

| | | | |
|---|---|---|---|
| 1,325,131 | 3/1963 | France | 418/113 |

*Primary Examiner*—John J. Vrablik

[57] ABSTRACT

A rotary engine of the trochoidal type in which the rotor and the profile of a basically trochoidally shaped inner housing wall bear such relationship to one another that when the differential in pressure in the flanking chambers is Greatest, the rotor apex seals are deliberately caused to stroke out, so that the resulting friction between the outwardly stroking apex seals and the sides of the rotor slots, so modifies the outward forces acting on the seals that the contact force between the seals and the housing wall are significantly less than they would be without such outward stroking of the apex seals. In one embodiment of the invention, the outward stroking of the apex seals results from the outward displacement of the profile of the inner housing wall surface along those stretches thereof at which the pressure differentials are greatest and, in another embodiment, the desired outward stroking is obtained by using an oversized two lobed-trochoidal profile for the inner housing wall and shifting the housing with respect to the rotor shaft along the major axis of the trochoid.

3 Claims, 12 Drawing Figures

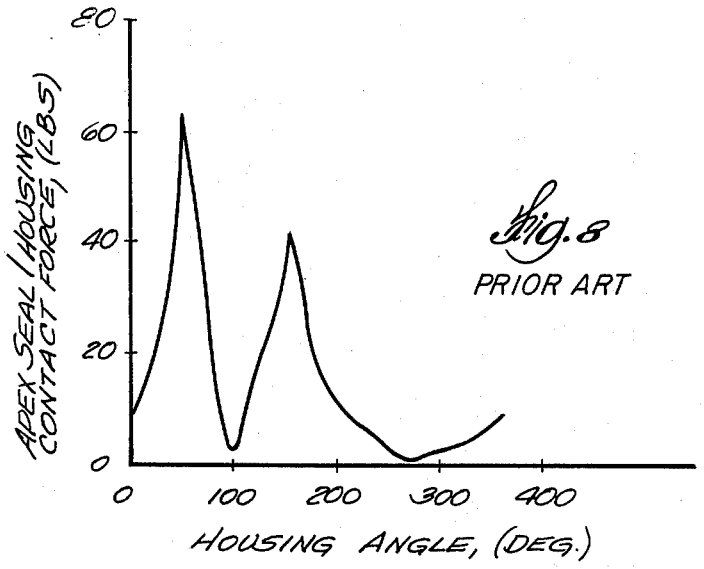

Fig. 8
PRIOR ART

COMPUTER PRODUCED ESTIMATE OF APEX SEAL/HOUSING CONTACT FORCE BASED ON THEORETICALLY TRUE TROCHOID HOUSING ON A 9.77 CU.IN. DISPLACEMENT ENGINE AT 3600 RPM AND MAXIMUM LOAD.

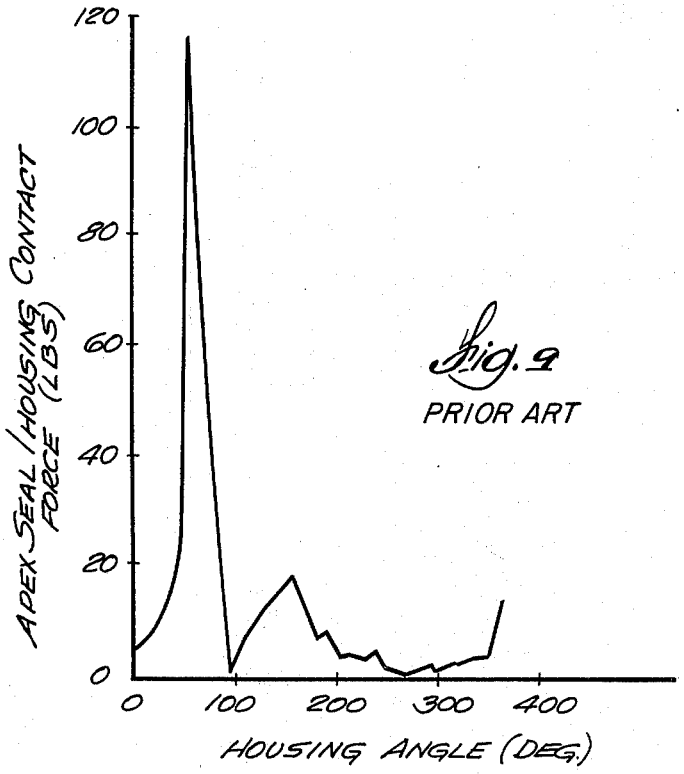

Fig. 9
PRIOR ART

COMPUTER PRODUCED ESTIMATE OF APEX SEAL/HOUSING CONTACT FORCE WITH A TROCHOID HOUSING WITH ESTIMATED THERMAL AND PRESSURE PRODUCED CURVATURE DISTORTIONS ON A 9.77 CU.IN. DISPLACEMENT ENGINE AT 3600 RPM AND MAXIMUM LOAD.

COMPUTER PRODUCED ESTIMATE OF APEX SEAL / HOUSING CONTACT FORCE WITH A MODIFIED TROCHOID HOUSING ON A 9.77 CU. IN. DISPLACEMENT ENGINE AT 3600 RPM & MAX. LOAD.

COMPUTER PRODUCED ESTIMATE OF SEAL / HOUSING CONTACT FORCE WITH A SHIFTED TROCHOID HOUSING ON A 9.77 CU. IN. DISPLACEMENT ENGINE AT 3600 RPM AND MAX LOAD.

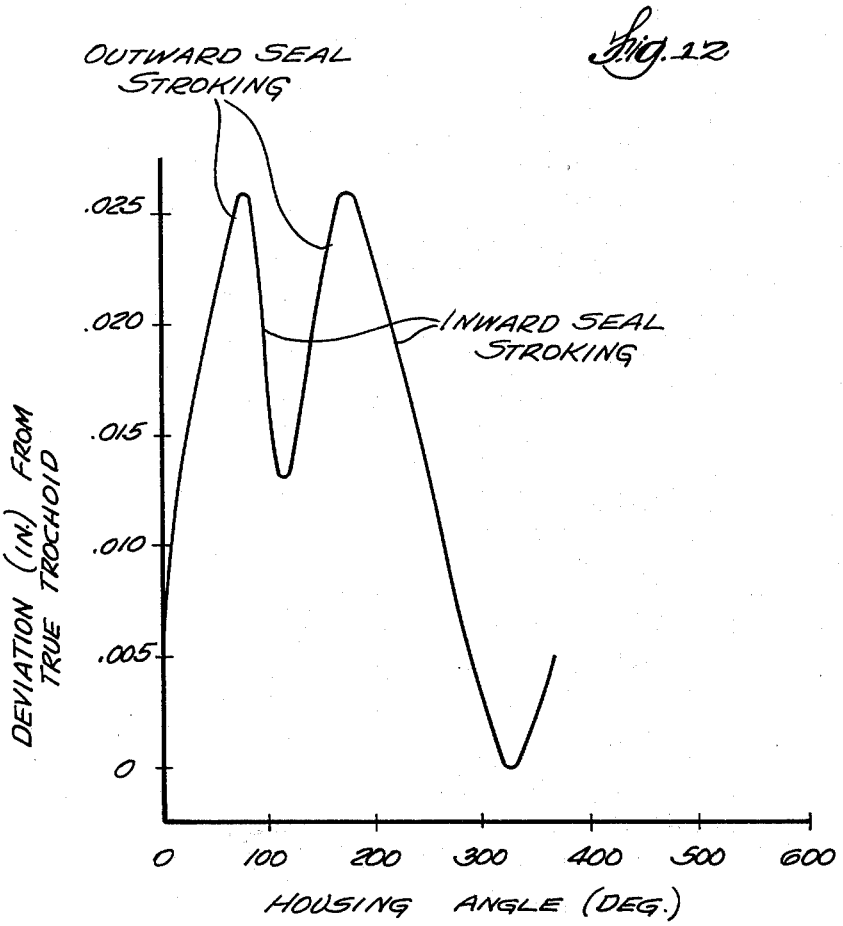
COMPUTER PRODUCED ESTIMATE OF HOUSING BORE DEVIATION FROM TRUE TROCHOID FOR PROFILE MODIFICATION.

ROTARY ENGINE WITH MODIFIED TROCHOIDALLY SHAPED INNER WALL

This invention relates to machines of the rotary-trochoidal engine type, wherein a rotor having circumferentially spaced apexes planetarily rotates in a housing having a basically trochoidally shaped inner wall surface with which the apexes of the rotor coact to define a plurality of discrete chambers. Accordingly, this invention is classifiable with the Froede U.S. Pat. No. 3,139,072 and the Jones U.S. Pat. No. 3,465,729, both of which mention the Wankel U.S. Pat. No. 2,988,008 — the latter being generally regarded as representative of the genesis of this type of rotary engine.

The history of the rotary engine establishes that it was realized, from the very beginning, that in order for the discrete chambers that are defined by the rotor and the trochoidally shaped inner housing wall and closed by the end walls of the housing, to be properly sealed from one another, suitable seals had to be located in the apexes of the rotor. A great deal of attention was directed to that objective, which entailed not only finding a satisfactory material for the seals and the best geometry of their shape, but also some way of coping with the destructive wear resulting from the sliding engagement between the seals and the housing wall. As the art developed, it became evident that the needed seals would be best supplied by sealing strips seated in transversely extending slots in the apexes of the rotor and yieldingly urged into engagement with the housing wall by springs reacting against the bottoms of the slots.

The only solution to the wear problem that to date has had any degree of success has been a very hard wear-resistant facing for the trochoidal inner housing wall. That facing has been provided in a number of different ways, all of which, however, significantly increase the cost of producing a rotary engine. This increase in cost is due both to the application of the hard facing and to the time-consuming grinding operations usually required to finish its surface. As a result, the rotary engine is not generally cost-competitive with the piston engine, particularly in the small engine market.

On the other hand, if the hard facing could be eliminated and either the bare housing surface or an inexpensive coating not requiring grinding used instead, the rotary engine would be much more attractive.

The present invention makes the attainment of that objective practicably feasible.

In order to understand how the invention accomplishes its purpose, it is necessary to identify the nature and source of the destructive wear of the trochoidal housing surface that occurs during operation of the engine. Failure to do that led others who have concerned themselves with this problem to entirely erroneous conclusions.

There are several modes or types of wear which can occur in a rotary engine housing, but two of primary concern are chatter damage and scoring. Chatter damage (closely successive deformations of the housing surface) has been the concern of several patents including the aforesaid Froede U.S. Pat. No. 3,139,072 and the later Bensinger U.S. Pat. No. 3,196,848. That chatter damage is not well understood is illustrated by the fact that these two patentees proposed diametrically opposite modifications to the shape of the trochoidal housing to overcome the problem. Bensinger so modified the profile that the apex seals were forced inward in their rotor slots in the regions where chatter occurred. Froede, on the other hand, proposed that the profile be modified so that the seals were forced outward in these regions. Regardless of the merits of these divergent efforts to prevent chatter damage, neither approach was concerned with the other major type of housing wear, scoring. In fact, their solutions to chatter damage would increase the likelihood of scoring in other regions of the housing.

Scoring is a severe form of wear which can occur when two smooth bodies are slid over each other under heavy loads. It is characterized by a welding or adhesion of minute asperities of the two surfaces. Fragments are pulled off as the junctions are broken by the sliding action. The amount of material removed is generally proportional to the load and is inversely proportional to the hardness of the surfaces. Thus two ways to minimize scoring are: (1) reduce the load and (2) increase the hardness of the surfaces.

As has been noted, the latter approach has been adopted in previous rotary engines, by means of hard facings on the housing wall. The present invention is directed towards the reduction of the contact loads between the apex seals and the housing surface, thereby obviating the need for expensive hard facings.

How chatter occurs and how it can be overcome is not germane to the scoring problem. The two types of wear are separate phenomena and do not normally even occur in the same regions of the housing. Scoring usually initiates in a region approximately sixty degrees in the direction of rotor rotation from the major axis of the trochoid, on the compression side of the housing. As will be shown, this corresponds to the location of maximum contact force between the apex seals and the housing. Chatter may occur to some extent in several locations, but is generally most severe on the expansion side of the housing, at a distance from the scored region.

Tests conducted with rotary engines having aluminum housings with bare, uncoated trochoidal surfaces showed that severe scoring wear initiated after only 7 to 9 hours of operation, only 2 of which were at maximum load conditions. No chatter damage was evident anywhere in the housings. In fact, chatter did not occur in these tests until after 20 to 40 hours of running and then only in the expansion lobe of the trochoid.

Scoring wear is therefore a major cause of early engine failure and is a problem which heretofore could only be solved by the use of very hard, expensive facings. The cost involved in applying and finishing those facings has kept the rotary engine from a competitive position, particularly in the vast small engine market. It is the solution of that problem in an inexpensive and reliable manner that constitutes the purpose and objective of this invention.

The invention is based upon an analysis of the forces acting on the apex seals which showed that the contact force between the seal and the housing wall peaks abruptly when the pressure differential in the chambers flanking the seal is greatest. The invention resides in the discovery that if outward stroking of the apex seals takes place as they traverse those stretches of the inner housing wall profile at which the greatest pressure differentials in the chambers flanking the seals exist, the friction incident to and resisting such outward stroking of the apex seals, between the relatively moving side walls of the seals and the rotor slots that are forcefully pressed together by that pressure differential, so modifies the outward force acting on the seals that the contact force between the seals and the housing wall is significantly less than it would be if there were no outward stroking during this interval.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate three complete examples of the physical embodiment of the invention constructed according to the best modes so far devised for the practical application of the principles thereof, and in which:

FIG. 3 is a cross section through an apex seal and depicting the forces acting on the strip during outward stroking thereof;

Figure 5:
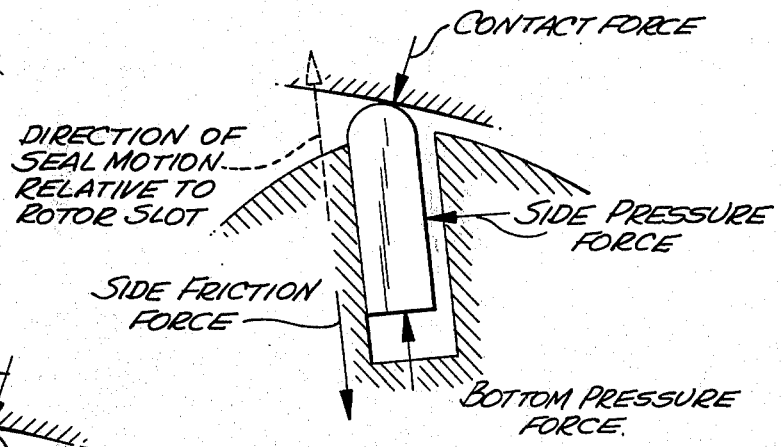
Figure 6:
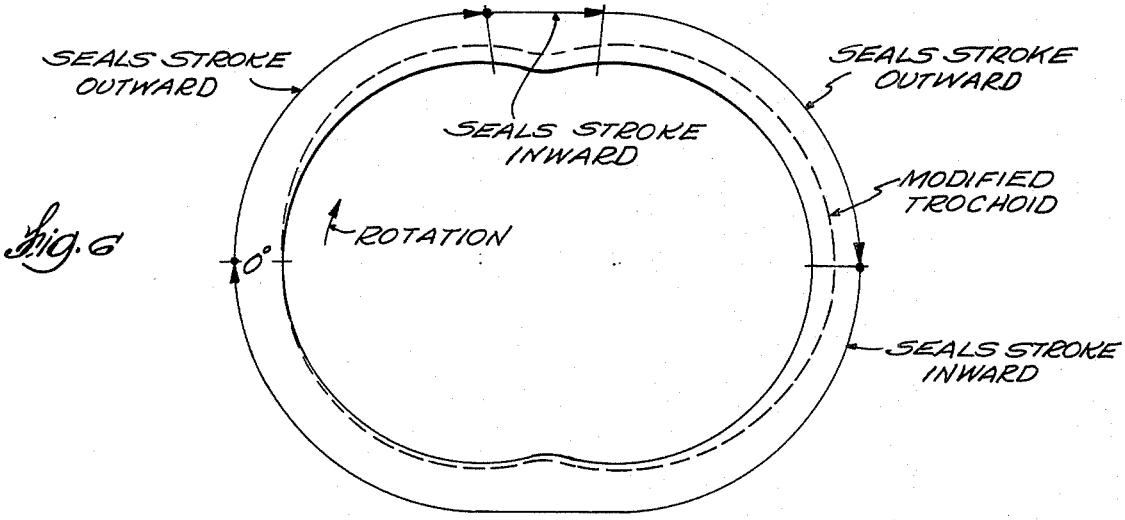
Figure 7:
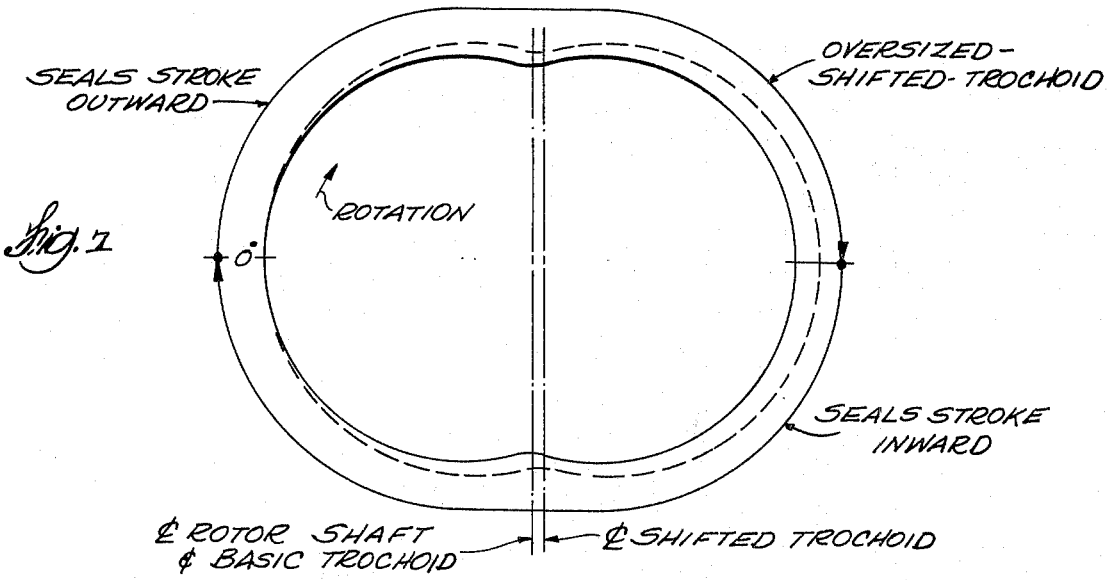

FIG. 5 is a profile of the trochoidal inner surface of the housing wall, illustrating in dot and dash lines and at a greatly exaggerated scale a modification from the true trochoidal shape of that profile to effect outward stroking of the apex seals as they traverse that lobe in the inner housing wall profile at which the greatest pressure differential exists in the chambers flanking the sealing strips;

FIG. 6 is a view similar to FIG. 5, illustrating a further modification of the housing wall profile by which additional outward stroking of the apex seals takes place in the other lobe of the trochoid;

FIG. 7 is also a profile of the trochoidal inner surface of the housing wall illustrating in dot and dash lines how outward stroking of the seals is effected by means of an oversized shifted trochoid.

Figure 10:
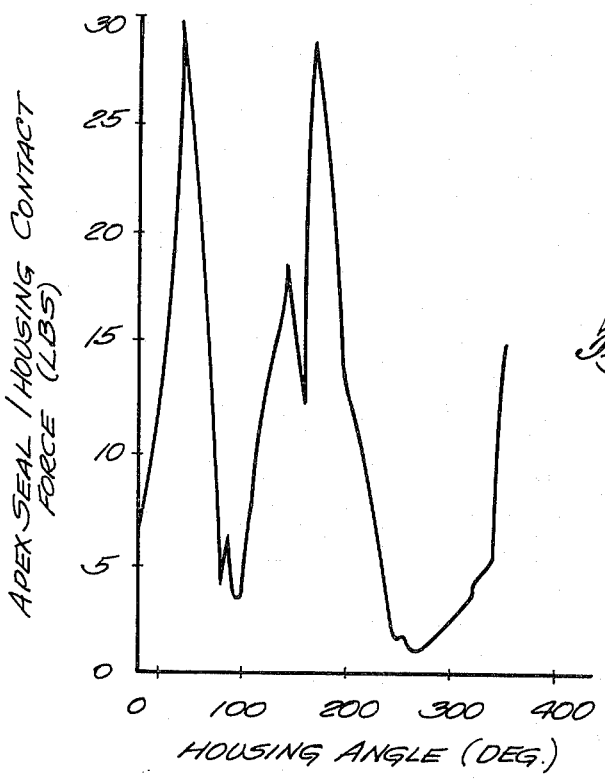
Figure 11:
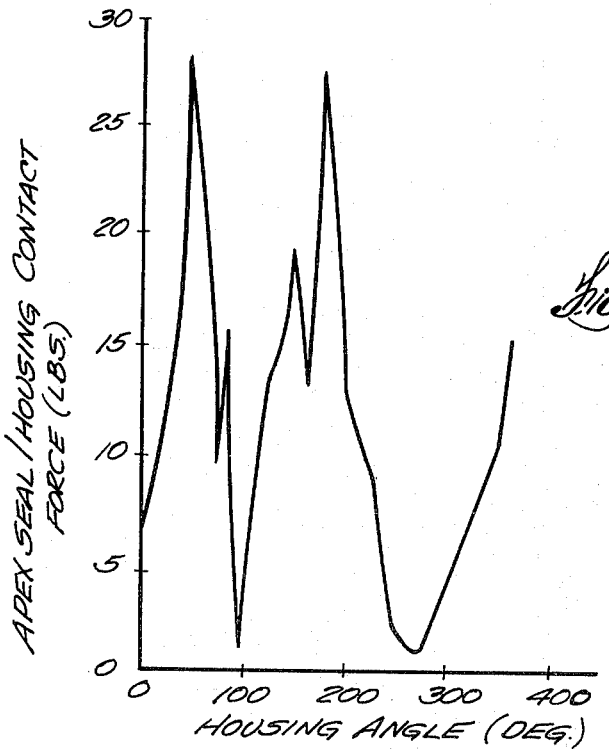

FIG. 8 is a chart depicting the theoretical seal/housing contact force in a conventional rotary engine that does not have the benefit of this invention;

FIG. 9 is a chart showing the calculated seal/housing contact force in a conventional rotary engine taking into account pressure and thermal distortions of the rotor housing;

FIG. 10 is a chart depicting the seal/housing contact force that exists in the same engine, but with the profile of its inner housing wall modified as depicted in FIG. 6;

FIG. 11 is a chart similar to FIG. 10 but depicting the seal/housing contact force in an engine in which the housing and rotor are shifted with respect to one another from their normal centered relationship as depicted in FIG. 7; and FIG. 12 is a chart illustrating the actual extent of the outward displacement of the inner housing wall shown in exaggerated fashion in FIG. 6 by which the seal/housing contact force was reduced to the values shown on the FIG. 10 chart.

Figure 1:
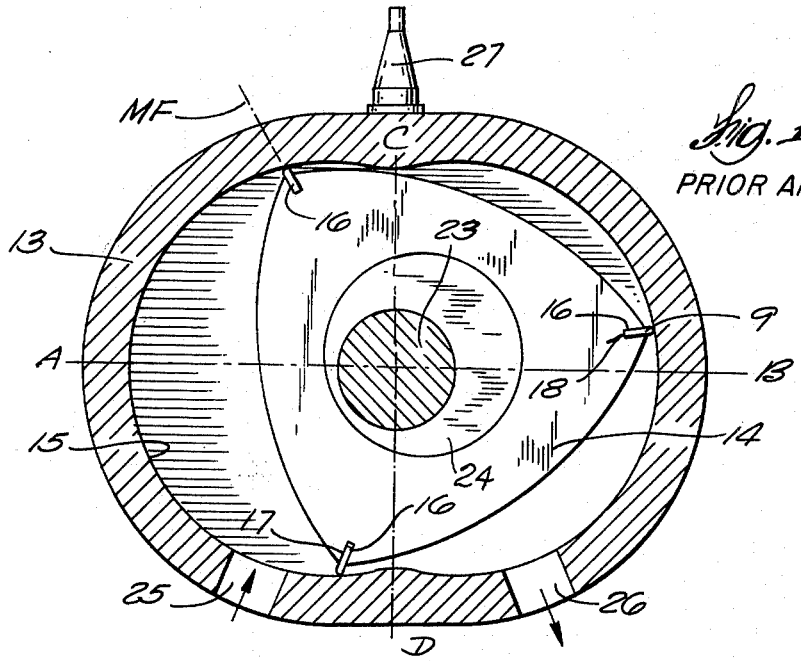
Fig. 1 PRIOR ART
FIG. 1 is a cross sectional view through a conventional rotary engine with its ignition means indicated diagrammatically.

Referring to the accompanying drawings, and considering first the structure shown in FIG. 1, the numeral 13 designates the rotor housing of a conventional rotary engine, which — together with side walls (not shown) that are secured to the opposite sides of the housing — forms a cavity that houses a rotor 14. The profile of the inner surface 15 of the housing is a two-lobed trochoid with a major axis A–B and a minor axis C–D. The rotor 14 has three apexes (one more than the two lobes of the trochoidal housing) in each of which there is a transversely extending slot 16. These slots open to the opposite faces of the rotor and have a uniform cross section from end to end defined by side walls 17 and a bottom wall 18.

Each rotor slot has an apex seal 19 seated therein with opposite side walls 20, a bottom edge 21 and a convexly curved outer edge 22. The relative cross sectional dimensions of the apex seals and the slots are such that the seals are free to move in and out radially with respect to the rotor axis, and the slots are deep enough to accommodate the entire range of in and out motion or stroking of the seals that takes place in accordance with this invention, without impairing the stability of the apex seals in the slots. The apex seals may be of single-piece or multi-piece construction.

Although not illustrated, there are springs in the bottoms of the slots that yieldingly project the apex seals outwardly into engagement with the inner wall surface 15 of the housing, but — as will be described — these springs do not by any means provide all of the outward force on the seals.

As is customary in a rotary engine, a rotor shaft 23 transpierces the side walls (not shown) of the housing with its axis generally coincident with the center of the trochoid defined by the intersection of its major and minor axes. This shaft constitutes the drive shaft of the engine and is journalled in bearings mounted in the side walls of the rotor housing. The shaft has an eccentric section 24 on which the rotor is freely rotatably mounted. Accordingly, the rotor revolves planetarily around the axis of the shaft and rotates about the axis of the eccentric during operation of the engine. The apexes of the rotor thus trace a trochoidal path, with the outer edges of the apex seals projecting slightly beyond the theoretical rotor apexes.

The housing profile is usually made slightly larger than the true trochoidal path of the rotor apexes by a distance approximately equal to the seal tip radius. The actual profile is then a curve parallel to a true trochoid. The term "basic trochoidal shape" referred to herein includes such a profile.

It might appear that the apex seals would slidingly engage the inner housing wall with a nearly uniform contact force due to their springs. However, in reality, there is a very wide variation in contact force due to gas pressures, inertia forces and friction forces acting on the seals. If that contact force is not sufficient to maintain the apex seals in good sealing engagement with the housing wall, the working chambers between the housing and the rotor will not be sealed from one another and the consequent "blow by" will keep the engine from delivering its intended power. On the other hand, if that contact force is too great, the wear of the contacting surfaces of the housing and the apex seals becomes a controlling factor in the useful life of the engine.

Of all of the forces acting on the apex seals, the gas pressure forces are the most significant. Even though the seals have a relatively tight fit in the slots in the rotor apexes, a differential in the gas pressure in the working chambers flanking a seal will be manifested in the slot beneath the seal and will press that seal against the housing wall with a force depending upon the magnitude of the pressure differential in the flanking chambers. Since that pressure differential varies as the working chambers travel around their orbit, it follows that the force with which the apex seals are thrust against the housing wall is by no means uniform around the profile of the housing wall.

Again referring to FIG. 1, it will be seen that intake and exhaust ports 25 and 26, respectively open into the trochoidally shaped housing cavity at opposite sides of its minor axis C–D but at the same side of its major axis A–B, and that ignition means — diagrammatically indicated at 27 — is located at the opposite side of the major axis. The ignition means may be a single spark plug, a series of spark plugs or any other suitable ignition device.

With the rotor turning in the clockwise direction, each working chamber successively passes through:

1. an intake phase which begins approximately when the leading apex seal of that chamber crosses the intake port 25;
2. a compression phase which begins when the trailing seal of that chamber crosses the intake port, and reaches full compression when the face of that chamber is at top dead center;
3. a power phase which results from the ignition of the compressed fuel mixture in that chamber; and
4. an exhaust phase which begins when the leading apex seal of that chamber uncovers the exhaust port 26.

As is customary, meshing internal and external gears (not shown) respectively fixed with respect to the rotor and the adjacent side wall of the housing, keep the rotor and housing correctly phased during the planetary rotation of the rotor.

It is, of course, understood that as a result of the planetary rotation of the rotor, the working chambers between the rotor and housing vary in volume to successively effect the aforesaid four phases of engine operation. It should also be evident that as the working chambers vary in volume, the gas pressure at opposite sides of the apex seals will differ. That pressure differential is greatest when the peak combustion pressure is reached in the chamber during the power phase. It reaches its maximum when the trailing apex seal passes a point approximately 60° beyond the major axis, which point is identified in FIG. 1 by the letters MF. As a result of that substantial pressure differential, the contact force between that apex seal and the housing wall is extremely large.

Figure 2:
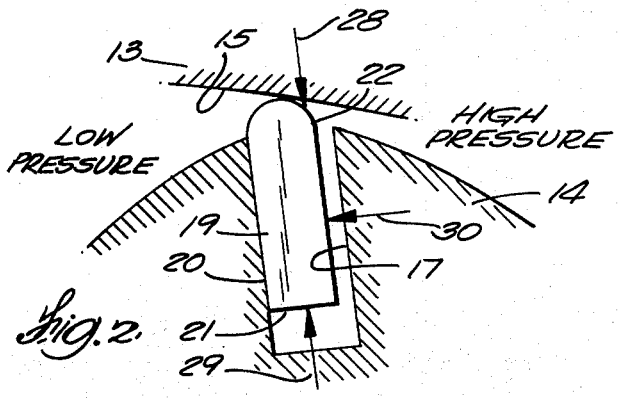
FIG. 2 is a cross sectional view through an apex portion of the rotor, illustrating the forces acting on the apex seal as a result of the pressure differential in the flanking chambers.

FIG. 2 illustrates the forces acting on the apex seal as a result of the pressure differential in the chambers flanking the seal. Attention is directed to the fact that although the high gas pressure applies a downward or inward force on the outer edge 22 of the seal — as indicated by the arrow 28 — the area of that edge exposed to the high gas pressure is less than the area of the bottom or inner edge 21 of the seal. Hence the force identified by the arrow 29 reacting between the inner edge of the seal and the bottom of the slot exceeds the force on the top or outer edge of the seal. The differential gas pressure at opposite sides of the apex seal also presses the seal against the trailing side of the rotor slot with a very large force, identified by the arrow 30.

The severity of the contact force between the apex seal and the inner wall surface 15 of the housing is graphically illustrated by the chart of FIG. 8. That chart depicts the seal/housing contact force that exists in a conventional rotary engine not having the benefit of this invention, i.e. a rotary engine with a housing in which the profile of its bore is a theoretically true trochoid of a size greater by the apex seal tip radius than the path traced by the apexes of the rotor. The chart was produced by a computer into which was fed all of the data needed to compute the contact force. Note that this force peaks at the point on the housing profile identified in FIG. 1 as MF, which is approximately 60° beyond the intersection of the housing profile with the major axis of the trochoid. Note also that this contact force rose to 63 pounds.

The curve on the chart also shows that at a point on the housing profile approximately 88° beyond the 63 pound peak, a second high contact force exists, but that peak rose only to something less than 45 pounds. The significant point about the curve in FIG. 8 is the very wide variation in contact force which it reveals.

The chart in FIG. 9 shows the calculated seal/housing contact force for the same conditions as in FIG. 8 except that the trochoid has been distorted by thermal and pressure effects. This is believed to be more representative of what actually occurs in a real engine than FIG. 8. Note that the peak contact force has reached a value of 115 pounds, the increase in force being due to inward stroking of the apex seal in its rotor slot under a large pressure differential.

The exceptionally high contact force depicted by the first peak in the curve on FIG. 9, and the abruptness of its rise to that value, explains why the surface 15 of the housing becomes gouged and scored in the region at which that force is greatest. There can be no doubt but that as a result of the high peak in seal/housing contact force in that area, the scoring that takes place seriously wears away the surface of the housing.

With the source of the destructive wear thus identified, it became evident that reduction of that wear resides in finding some way to reduce the contact force. That objective has been achieved by so modifying the profile of the basically trochoidally shaped inner housing surface as to cause the apex seals to stroke out as they traverse the stretches of their orbit at which the contact force is greatest. As a result of that outward stroking, an alleviating force is added to those already acting on the seals. This is the force of friction between the contacting side faces of the apex seals and the rotor slots they occupy. The braking effect of that friction so modifies the outward forces acting on the seals that a significant reduction in the contact force is obtained.

Figure 4:
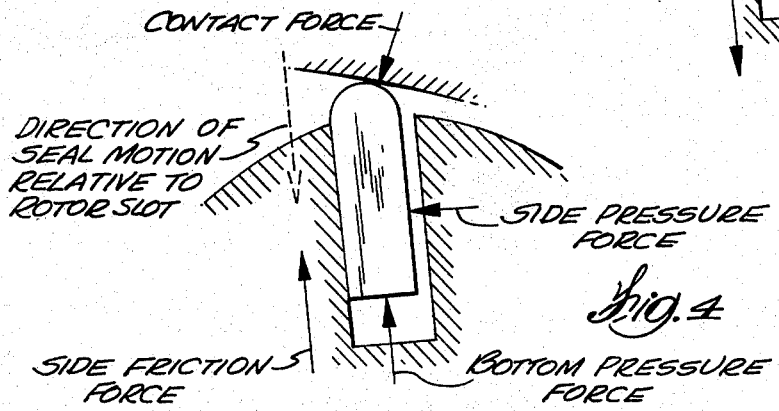
FIG. 4 is a view similar to FIG. 3 but depicting the forces that act on the seal during inward stroking.
Figure 5:
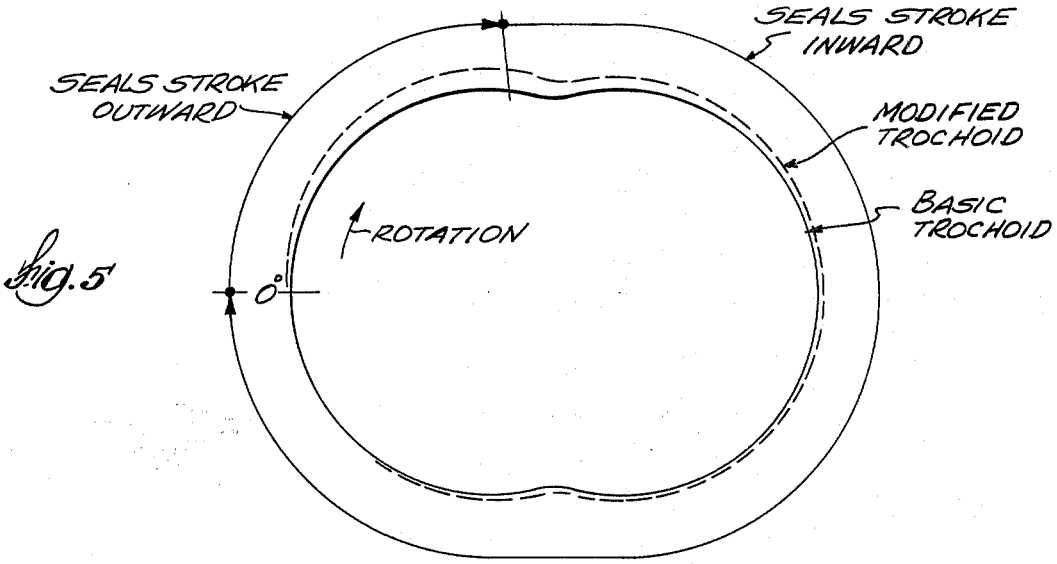

FIG. 3 graphically illustrates how the side friction between the apex seals and the rotor slots they occupy opposes the pressure under the seals and thereby reduces the contact force; and FIG. 4 illustrates the manner in which that side friction adds to the contact force during inward stroking of the apex seals.

FIG. 5 illustrates one way of modifying the profile of the inner wall surface of the housing to cause the apex seals to stroke out where a reduction in contact force is desired. The modified profile of FIG. 5 causes the seals to stroke out along a stretch of the profile of the left-hand lobe of the trochoid that begins at about the point the major axis of the trochoid intersects the profile and continues past the point at which the differential gas pressure in the chambers flanking an apex seal traversing said stretch is greatest. Beyond that stretch, the profile of the inner housing surface gradually approaches the basic trochoidal shape.

FIG. 6 illustrates a further modification of the housing wall profile by which the apex seals undergo a second outward stroking which takes place in the right-hand lobe and thus deals with the second and lesser of the peaks in contact force depicted by the curve in FIG. 9.

The reduction in contact force brought about by deliberately causing the apex seals to stroke out as they traverse that stretch of the housing profile where the pressure differential in the flanking chambers is greatest, is illustrated by a comparison of the charts of FIGS. 9 and 10. The parameters of the engines used in the production of the two charts were identical. The only difference was that — for the FIG. 10 chart — the profile of the housing wall was modified from the basic trochoidal shape to that shown in FIG. 6. Comparison of the two charts shows that the contact force in two engines of the same size operating under the same conditions is significantly lower if the profile of the inner housing wall is modified to deliberately cause outward stroking when the pressure differential in the flanking chambers is greatest. Note that the peak contact force in FIG. 10 is less than one-half of what it is in FIG. 8, and less than one-fourth of what it is in FIG. 9.

A series of engine tests was run with bare aluminum housings with both basically true trochoid profiles and modified trochoid profiles as shown in FIGS. 5 and 6. The true trochoid housings failed through excessive scoring in the maximum load region in less than 9 hours. The modified trochoid housings did not show any scoring damage in runs up to 30 hours.

The use of an oversized trochoid for the housing and shifting the same with respect to the rotor shaft, as shown in FIG. 7, also brings about outward stroking and effects substantially the same reduction in contact force, as will be seen from a comparison of FIGS. 9 and 11, the latter being the contact force curve of the engine with a shifted-oversized housing.

The oversized trochoid can be achieved by using a distance between the true trochoid traced by the rotor apexes and a parallel housing curve which is larger than the apex seal tip radius. The center of the oversized trochoid can then be shifted to make it tangent to a parallel trochoid at the point at which outward stroking of the apex seal is to begin. The use of an oversized shifted trochoid has the advantage that it can be manufactured by conventional trochoid-generating machine tools.

To illustrate how slight a modification or deviation from the basic trochoidal profile is needed to achieve a reduction in contact force from 115 pounds to less than 30 pounds, the computer-produced chart of FIG. 12 has been included in this disclosure. The chart is self-explanatory, but it should be noted that it depicts the dual outward stroking obtained by the profile modification of FIG. 6.

Since, as depicted in FIG. 4, inward stroking of the apex seals adds to contact pressure, it follows that by shaping the inner housing wall profile to cause inward stroking along those stretches of the profile at which the other forces acting on the seals can not be depended upon to maintain the desired sealing engagement between the seals and the housing wall, an additional advantage is gained.

It is obvious that if the contact force between the apex seal and the housing surface is reduced, the wear of the apex seal will be minimized as well as that of the housing surface. Therefore the benefits of this invention may extend to include the use of lower cost materials for the apex seals.

While the invention has been described from the standpoint of its adaptation to a rotary internal combustion engine equipped with spark plug or equivalent ignition, it is to be understood that it is equally applicable to diesel engines, pumps, blowers and compressors and — unless otherwise restricted — the appended claims should be construed as also encompassing the invention in those environments.

Those skilled in the art will appreciate that the invention can be embodied in forms other than as herein disclosed for purposes of illustration.

The invention is defined by the following claims:

1. In a machine of the character described, wherein a rotor having circumferentially spaced apexes is journalled on an eccentric portion of a rotor shaft rotatably mounted in a housing that has an inner peripheral wall surface of basically trochoidal shape with a plurality of lobes, radiating from a common center, said lobes being one less in number than the number of rotor apexes, and each lobe being symmetrical about a center line radiating from said common center and being separated by a cusp from its next adjacent lobe in the direction of rotor rotation, the apexes of the rotor coacting with said inner peripheral wall to define a plurality of discrete working chambers that vary in volume as rotation of the rotor about the shaft orbitally moves the apex seals along said inner peripheral wall surface, said discrete chambers being sealed from one another by means including apex seals that occupy transverse slots in the apexes of the rotor so that pressure differentials in the chambers flanking the apex seals and manifested in the slots force the apex seals against said inner peripheral wall surface of the housing and also against a side of the slots they occupy, the pressure differential at opposite sides of each apex seal varying as the seal traverses the inner peripheral wall surface of each lobe, increasing significantly as the seal moves through the lobe, customarily identified as the compression lobe when the machine is a rotary engine, to reach maximum at a location approximately two-thirds the circumferential distance from a point at which the centerline of that lobe intersects said surface to the cusp dividing that lobe from its next adjacent lobe, then diminishing from said location as the apex seal crosses the cusp and again increasing and diminishing as the seal traverses the next adjacent lobe, the improvement by which scoring of said inner peripheral wall surface of the housing by the forced engagement therewith of the apex seals is significantly minimized, and which improvement resides in:

means to effect outward stroking of each apex seal in the slot it occupies as the seal traverses said identified lobe, the magnitude of said outward stroking reaching its maximum at a point beyond the location at which the differential in pressure at opposite sides of the seal is greatest, the means for effecting said outward stroking of the apex seals residing in an outward displacement of the inner peripheral wall surface of said identified lobe from an imaginary path that would be traced by the sealing edges of the apex seals upon rotation of the rotor and the shaft if said seals remained in identical positions with respect to the rotor axis and neither stroked inward nor outward, said outward displacement of the inner peripheral wall surface from said imaginary path commencing substantially at the point said surface is intersected by the centerline of said identified lobe and gradually increasing in magnitude from said point to reach maximum at a point beyond the location on the orbit of the apex seals at which the pressure differential at opposite sides thereof is greatest, and from said point of maximum outward displacement gradually decreasing in magnitude but continuing across said cusp into the next adjacent lobe, and then merging gently with the aforesaid imaginary path.

2. The invention defined by claim 1, wherein the magnitude of said outward displacement of the inner peripheral wall surface of the housing decreases from said point of maximum outward displacement along a stretch of said wall surface that crosses said cusp and extends into the next adjacent lobe, then from a point spaced a short distance beyond said cusp and in the next adjacent lobe gradually increases in magnitude to reach maximum at a location in said next adjacent lobe downstream from the point at which the pressure differential across the apex seals transversing said next adjacent lobe is greatest, and then gradually decreases in magnitude to merge gently with the aforesaid imaginary path.

3. The invention of claim 1, wherein the profile of the inner peripheral wall surface of the housing is a two-lobed trochoid with a major axis that passes symmetrically through both lobes and hence forms said centerline of the lobes, and a minor axis that passes through said cusp and a second diametrically opposite cusp, wherein the profile of said inner peripheral wall surface is alike in configuration to said imaginary path but larger in size; and wherein said outward displacement of said inner peripheral wall surface results from the housing being offset along said major axis with respect to the axis of the rotor shaft a distance such that the point at which the outward displacement of said inner peripheral wall surface begins is tangent to said imaginary path.

* * * * *